US008511276B2

(12) United States Patent
Omori

(10) Patent No.: US 8,511,276 B2
(45) Date of Patent: Aug. 20, 2013

(54) CAT-AND-MOUSE TYPE INTERNAL COMBUSTION ENGINE, AND ITS CORRELATION TYPE CRANK

(76) Inventor: Tatsunobu Omori, Hyogo (JP)

( * ) Notice: Subject to any disclaimer, the term of this patent is extended or adjusted under 35 U.S.C. 154(b) by 819 days.

(21) Appl. No.: 12/602,901

(22) PCT Filed: May 8, 2008

(86) PCT No.: PCT/JP2008/058545
§ 371 (c)(1),
(2), (4) Date: Dec. 3, 2009

(87) PCT Pub. No.: WO2008/149633
PCT Pub. Date: Dec. 11, 2008

(65) Prior Publication Data

US 2010/0180858 A1 Jul. 22, 2010

(30) Foreign Application Priority Data

Jun. 5, 2007 (JP) ..... 2007-174618
Jul. 11, 2007 (JP) ..... 2007-207200
Jan. 16, 2008 (JP) ..... 2008-006712

(51) Int. Cl.
*F02B 53/00* (2006.01)

(52) U.S. Cl.
USPC ..... 123/245; 123/241

(58) Field of Classification Search
USPC ..... 123/241, 245, 18 A, 18 R, 45 R; 418/36, 37, 38
See application file for complete search history.

(56) References Cited

U.S. PATENT DOCUMENTS

| | | | | | |
|---|---|---|---|---|---|
| 1,568,053 | A * | 1/1926 | Bullington | 123/202 |
| 2,124,327 | A * | 7/1938 | Wolstenholme | 418/36 |
| 2,413,589 | A * | 12/1946 | Snyder | 418/36 |
| 3,139,871 | A * | 7/1964 | Larpent | 123/245 |
| 3,327,692 | A * | 6/1967 | Keagle | 123/245 |
| 3,580,228 | A * | 5/1971 | Rocha et al. | 123/18 A |
| 4,437,441 | A * | 3/1984 | Menioux | 123/213 |
| 4,872,818 | A * | 10/1989 | Takami | 418/36 |
| 7,415,962 | B2 * | 8/2008 | Reisser | 123/245 |
| 8,033,265 | B2 * | 10/2011 | Reisser | 123/245 |

FOREIGN PATENT DOCUMENTS

| | | | |
|---|---|---|---|
| DE | 3038500 | A1 | 10/1980 |
| JP | 56-159504 | A | 12/1981 |
| JP | 59168223 | A * | 9/1984 |
| JP | 61-047967 | A | 3/1986 |
| JP | 05-007524 | B2 | 1/1993 |
| JP | 59-168223 | A | 9/1994 |
| JP | 06-323103 | A | 11/1994 |
| JP | 09-303101 | A | 11/1997 |

OTHER PUBLICATIONS

International Search Report for corresponding Application No. PCT/JP2008/058545 mailed Aug. 12, 2009.

* cited by examiner

*Primary Examiner* — Kenneth Bomberg
*Assistant Examiner* — Paolo Isada
(74) *Attorney, Agent, or Firm* — Renner, Otto, Boisselle and Sklar, LLP

(57) ABSTRACT

Provided is a cat-and-mouse type internal combustion engine of concentric two-rotor/six-piston type, which has a cooling chamber in its cylinder housing and which needs neither any lubricating oil nor any valve mechanism so that its structure is simple and compact and can be easily manufactured. Further provided are a variable correlation type crank for a constant-pressure burning (CPB) engine of a variable compression ratio, and an inertial correlation type crank for a premixed compression ignition (HCCI), thereby to realize an internal combustion engine, which matches fuels of various kinds and which has a high energy efficiency and a clean exhaust gas.

7 Claims, 13 Drawing Sheets

CROSS-SECTIONAL VIEW OF ROTATION TRANSMISSION MECHANISM

CROSS-SECTIONAL VIEW OF PISTONS AND ROTORS

A-A' CROSS SECTION

A-A' VIEW

A-A' VIEW

A-A' VIEW

CROSS-SECTIONAL VIEW OF ROTATION TRANSMISSION MECHANISM

CROSS-SECTIONAL VIEW OF PISTONS AND ROTORS

CROSS-SECTIONAL VIEW OF ROTATION TRANSMISSION MECHANISM

CROSS-SECTIONAL VIEW OF PISTONS AND ROTORS

LARGE ACCELERATOR OPENING DEGREE

CAT-AND-MOUSE TYPE INTERNAL COMBUSTION ENGINE, AND ITS CORRELATION TYPE CRANK

TECHNICAL FIELD

The present disclosure relates to a so-called cat-and-mouse type internal combustion engine in which two concentric rotors each including three pistons swing or rotate with a change in angular velocity in a cylinder housing (which is not limited to a cylindrical shape and may be in any shape herein) to increase/decrease space between the pistons so that operation strokes, such as intake and compression strokes, of the internal combustion engine are performed.

BACKGROUND ART

Internal combustion engines utilizing a volume change among pistons are known in the following documents:

PATENT DOCUMENT 1: Japanese Patent Publication No. 56-159504

PATENT DOCUMENT 2: Japanese Patent Publication No. 59-168223

PATENT DOCUMENT 3: Japanese Patent Publication No. 61-47967

PATENT DOCUMENT 4: Japanese Patent Publication No. 5-7524

PATENT DOCUMENT 5: Japanese Patent Publication No. 6-323103

PATENT DOCUMENT 6: Japanese Patent Publication No. 9-303101

PATENT DOCUMENT 7: U.S. Pat. No. 3,139,871

PATENT DOCUMENT 8: German Patent Application No. 30 38 500

Various techniques of utilizing a periodical change in space between pistons, i.e., inter-piston space, for operation strokes of an engine have actually been employed in pumps and compressors. Internal combustion engines utilizing such techniques are often considered to be similar to pumps or the like in appearance, recalling a relationship of reversible energy direction, e.g., a relationship between a motor and a power generator or between a reciprocating engine and a reciprocating pump. These internal combustion engines are distinctly different from pumps or the like in terms of mechanical engineering in an aspect in which a rotation transmission mechanism for eliminating interference of reverse rotational forces on pistons at rear portions of an explosive combustion chamber in normal rotational forces in order to prevent the reverse rotational forces from being transmitted to an output shaft is needed, and in an aspect in which a large amount of heat generated in an explosive combustion stroke requires particular cooling for, for example, the pistons. Some of known internal combustion engines of this type do not seem to be configured under consideration of the above differences. For example, in such an internal combustion engine, a rotation transmission mechanism in which normal and reverse rotational forces are completely fixed by, for example, gears and which is used only in a pump or a compressor, is applied to an internal combustion engine. Thus, appropriate internal combustion engines of this type have not been obtained yet.

In addition, it is necessary to compress a necessary minimum amount of air or air fuel mixture having a stoichiometric air-fuel ratio to a pressure as high as possible within a knocking limit according to a necessary applied torque in the entire range from a low load to a high load, and to burn the air fuel mixture, in terms of energy efficiency in thermodynamics and of exhaust gas purification. In a general internal combustion engine having a constant compression ratio with a fixed cylinder volume and a fixed combustion-chamber volume, when the amount of intake combustion gas varies, the combustion pressure of the combustion chamber also varies in proportion to the amount of intake air. Accordingly, such an internal combustion engine has a problem in which the combustion pressure and the energy efficiency generally decreases as the amount of intake gas decreases.

A variable stroke mechanism and a movable cylinder head mechanism in a reciprocating engine are known as variable control mechanisms of a combustion-chamber volume. In addition, an EGR technique of recirculating exhaust gas to a combustion chamber so as to reduce the combustion-chamber volume accordingly, is also associated with control of the combustion-chamber volume.

SUMMARY OF THE INVENTION

Technical Problems

A cylinder and pistons of a cat-and-mouse type internal combustion engine have simple configurations without valve mechanisms, are shaped to be a basically perfect circle, and thus can be easily fabricated in terms of working accuracy. In addition, rotating pistons employed in the engine reduces vibration, and both of the front and back surfaces of the pistons are used for operation strokes, thereby achieving compact size and high engine efficiency. In other words, the internal combustion engine of this type is expected to have high performance and to be achieved at low cost.

To achieve this internal combustion engine, various tasks need to be accomplished. A first task is to provide a rotation transmission mechanism for solving mechanical problems by eliminating interference of reverse rotational forces on pistons at rear portions of an explosive combustion chamber in normal rotational forces in order to prevent the reverse rotational forces from being transmitted to an output shaft.

A second task is to provide a technique for cooling the inside of the cylinder housing in order to deal with the necessity of employing a structure of a closed cylinder in spite of high engine efficiency.

With respect to a compression ratio regarding the energy efficiency, inter-piston space, i.e., the combustion-chamber volume, is determined by the timing of start of collision of correlating crankshafts with collision mechanisms, and is used as a compression ratio of an internal combustion engine of the type disclosed herein. In view of this, a third task is to control the angle at the timing of start of collision of the correlating crankshafts by changing, i.e., increasing/decreasing, the combustion-chamber volume according to the amount of intake gas in the combustion-chamber in order to keep a combustion pressure constant (i.e., to obtain constant pressure burn: CPB) with a constant air-fuel ratio.

A fourth task is to achieve a mechanism obtained by developing the foregoing configuration and intended to rapidly increase the pressure of the combustion chamber beyond the pressure associated with self-ignition when the piston reaches a given position, i.e., to achieve homogeneous charge compression ignition (HCCI).

Solution to the Problems

When planet gears (6-1, 6-2) having their rotational axes on an output arm (9) rotate with sun-and-planet motion with rotation of an output shaft (10), while meshing with an internal gear frame (11) fixed to the engine body and having teeth in a number three times as large as that of each of the planet gears (6-1, 6-2), eccentric rods (7-1, 7-2) located at a given distance from rotational axes (8-1, 8-2) of the planet gears (6-1, 6-2) each form a path similar to a rounded equilateral triangle, and rotate with a periodic change in angular velocity when viewed from the center of the output shaft (10). The eccentric rods (7-1, 7-2) are respectively coupled to correlating crankshafts (41-1, 41-2) through link members (5-1, 5-2) to cause two rotors (2-1, 2-2) to rotate with the change in angular velocity as described above.

The change in angular velocity of the rotors (2-1, 2-2) causes the volume between six pistons (1*a*, 1*b*, 1*c*; 1*d*, 1*e*, 1*f*) each three of which are arranged in each of the rotors (2-1, 2-2) in a cylinder housing (30) to periodically increase or decrease.

When the eccentric rods (7-1, 7-2) are located at an identical distance from the central rotational axes (8-1, 8-2) of the planet gears (6-1, 6-2) in the same phase, the pistons (1*a*, 1*b*, 1*c*; 1*d*, 1*e*, 1*f*) arranged at a pitch of 120° on the rotors (2-1, 2-2) periodically rotate such that each of the pistons (1*a*, 1*b*, 1*c*; 1*d*, 1*e*, 1*f*) of one of the rotors (2-1, 2-2) moves to the previous position of an associated one of the pistons (1*a*, 1*b*, 1*c*; 1*d*, 1*e*, 1*f*) of the other rotor (2-1, 2-2) every time the output shaft (10) and the output arm (9) provide a ⅙ turn.

To utilize this change in the volume of space between these pistons (1*a*, 1*b*, 1*c*; 1*d*, 1*e*, 1*f*) in the cylinder housing for operation strokes of intake, compression, explosion, gas exhaust, coolant intake, and coolant drain, an air intake port, an air exhaust port, a coolant intake port, a coolant injection nozzle, a coolant drain port, and either an ignition plug or a fuel injection nozzle are provided at given positions in the cylinder housing (30).

For reasons described in the next paragraph, the link members (5-1, 5-2) are made of either a steel member with hinges or a wire of one of carbon fiber, aramid fiber, and a flux of high tensile steel wires such that the link members (5-1, 5-2) become tense to transmit force under a tension, and bend to transmit no force under a compression. To prevent overcompression in a compression chamber occurring when the rotation of the pistons (1*a*, 1*b*, 1*c*; 1*d*, 1*e*, 1*f*) forming the compression chamber deviates from a specific periodic change and becomes free because of the bending of the link members (5-1, 5-2), colliding parts (13-1, 13-2) and collision receiving parts (24-1, 24-2) for providing collision at a given angle are provided in the correlating crankshafts (41-1, 41-2) directly coupled to the rotors (2-1, 2-2), thereby ensuring a sufficient combustion chamber volume.

Reverse rotational forces on the pistons (1*a*, 1*b*, 1*c*; 1*d*, 1*e*, 1*f*) at rear portions of the explosive combustion chamber are not transmitted to the connected correlating crankshafts (41-1, 41-2) by the bending of the link members (5-1, 5-2). Reverse rotational forces of the pistons (1*a*, 1*b*, 1*c*; 1*d*, 1*e*, 1*f*) and the rotors are received by one-way clutches (12-1, 12-2) disposed between the engine body and the rotor shafts (3-1, 3-2), and as a result, reverse turns of the pistons (1*a*, 1*b*, 1*c*; 1*d*, 1*e*, 1*f*) are prevented, thereby supporting an effective transfer of an expansion pressure to the pistons (1*a*, 1*b*, 1*c*; 1*d*, 1*e*, 1*f*) at the front portions of the explosive combustion chamber. On the other hand, normal rotational forces on the pistons (1*a*, 1*b*, 1*c*; 1*d*, 1*e*, 1*f*) at the front portions of the explosive combustion chamber are transmitted to the correlating crankshafts (41-1, 41-2) under strain of the link members (5-1, 5-2), to serve as an rotation output of the engine. The foregoing configuration can accomplish the first task, and implements an internal combustion engine of claim 1.

Six chambers (g, h, i, j, k, l) defined by the pistons (1*a*, 1*b*, 1*c*; 1*d*, 1*e*, 1*f*) in the cylinder housing (30) of the internal combustion engine of this disclosure can be assumed to be associated with six strokes, i.e., intake, compression, explosion, gas exhaust, coolant intake, and coolant drain, of the engine. In a cooling chamber for coolant intake or coolant drain, which is one of features of this disclosure, the rotors and the pistons (1*a*, 1*b*, 1*c*; 1*d*, 1*e*, 1*f*) can be appropriately cooled by a direct contact with a coolant, thereby accomplishing the second task. The foregoing two tasks are accomplished as the internal combustion engine of claim 1.

Instead of, or in addition to, the coolant intake port described above, a coolant liquid injection nozzle may be provided, thereby achieving higher cooling performance by utilizing heat of vaporization. Further, the cooling technique of this disclosure is applied to cooling of a heat generating section, and thus is effective when a heat-resistance or low-thermal-conductivity material, such as ceramic, is applied to the rotors, the pistons (1*a*, 1*b*, 1*c*; 1*d*, 1*e*, 1*f*), and a heat-receiving portion of the cylinder housing. In this application, it is possible to prevent an excessive temperature rise of these heat-receiving members, thereby reducing thermal damage or thermal deformation.

The outer surfaces of the rotors and the pistons (1*a*, 1*b*, 1*c*; 1*d*, 1*e*, 1*f*) or the inner surface of the cylinder housing are/is formed to be in the form of a basically simple perfect circle, and thus the working accuracy can be easily enhanced in machining. In addition, the surfaces of the pistons (1*a*, 1*b*, 1*c*; 1*d*, 1*e*, 1*f*) and the rotors or the cylinder housing face each other, and thus it is possible to reduce pressure leakage without piston rings and lubricating oil. Accordingly, a simple mechanism can be obtained at low cost, thereby reducing friction for a smaller energy loss. In particular, the absence of oil can also contribute to purification of exhaust gas.

In the internal combustion engine of this disclosure, the timing of start of collision of the correlating crankshafts (41-1, 41-2) having collision mechanisms determines the combustion-chamber volume which is inter-piston space.

Wire driving pulleys (31-1, 31-2) are attached to the shafts of stepper motors (15-1, 15-2) controlled according to the accelerator opening degree. Two driving wires (16-1*a*, 16-1*b*; 16-2*a*, 16-2*b*) are wound around the drums thereof in normal and reverse directions. Both ends of each of the two wires are coupled to two slide wedges (21-1*a*, 21-1*b*; 21-2*a*, 21-2*b*) which slide along slide rails (14-1, 14-2) via reels (17-1, 17-2). A V-shaped valley formed in top sides of two wedges whose slopes faces each other and which extend in parallel with each other in opposite directions, allows the colliding parts (13-1, 13-2) located on middle portions of the valley according to slides of the wedges to vertically slide within collision holders (28-1, 28-2), thereby changing the amount of, or the timing of start of, collision, i.e., obtaining a so-called variable collision mechanism, and transmitting an impact force of the collision to the associated variable correlating crankshafts (42-1, 42-2) upon the collision, without a shift of directional properties of the impact force. Since the height of the colliding parts determines inter-piston space, i.e., the combustion-chamber volume, upon collision, the combustion-chamber volume is variable, thereby obtaining a variable compressibility and achieving combustion under a constant pressure. In this manner, the third task is accomplished. The foregoing variable correlating crankshafts (42-1, 42-2) are recited in claim 2.

In an alternative embodiment, the wire driving pulleys (31-1, 31-2) are attached to the shafts of the stepper motors (15-1, 15-2) controlled by using the accelerator opening degree, both ends of a single driving wire (16-1, 16-2) wound around the wire driving pulleys (31-1, 31-2) is directly coupled to the colliding parts (13-1, 13-2) via the reels (17-1, 17-2), and the feed speed of the driving wire (16-1, 16-2) is set to be the amounts of travel of the colliding parts (13-1, 13-2) without change. The colliding parts (13-1, 13-2) slide across the slide rails (14-1, 14-2) to be positioned on the rails. The shapes of the collision receiving parts (24-1, 24-2) associated with the colliding parts are formed such that a given timing of start of collision is obtained. The variable correlating crankshafts (43-1, 43-2) including the foregoing variable collision mechanism are recited in claim 3.

Another variable collision mechanism can be obtained by replacing the stepper motors (15-1, 15-2), the wire driving pulleys (31-1, 31-2), the driving wire (16-1, 16-2), and the reels (17-1, 17-2) of claim 3 with stepper motors (15-1, 15-2) and worm gears (29-1, 29-2). This variable collision mechanism can also accomplish the third task, and is recited in claim 4.

A piston-position sensor (20) is provided at the tips of the pistons (1*a*, 1*b*, 1*c*; 1*d*, 1*e*, 1*f*) and the rotor shafts (3-1, 3-2) and the periphery along which the pistons and rotor shafts rotate, such that a positional signal is used as an input signal for ignition or fuel injection. In addition, a driving source to an actuator of the collision mechanism and sliding connectors (19-1, 19-2) for inputting/outputting a control signal are provided.

When a necessary torque is indicated according to the accelerator opening degree, a throttle valve is opened to a degree corresponding to the indication, resulting in that a corresponding amount of air or air fuel mixture is taken into the cylinder housing (30). An accelerator opening degree signal passes through the sliding connectors (19-1, 19-2) to reach the actuator of the collision mechanisms of the variable correlating crankshafts (42-1, 42-2, 43-1, 43-2, 44-1, 44-2) so that the variable collision mechanism is set to a state of a corresponding amount of collision. When the compression stroke progresses and collision starts, the combustion-chamber volume reaches an appropriate volume, and the pressure of the combustion chamber reaches an ideal combustion pressure. Subsequently, when rotation is further performed so that the pistons (1*a*, 1*b*, 1*c*; 1*d*, 1*e*, 1*f*) reach given positions, i.e., ignition positions determined by the combustion speed and the engine rotation speed, depending on the quality or type of fuel, and by the shapes of the cylinder housing (30) and the pistons (1*a*, 1*b*, 1*c*; 1*d*, 1*e*, 1*f*), the position sensor (20) detects this state to provide an instruction of ignition or fuel injection, and resets the state in which the accelerator opening degree is maintained, which will be described below. The foregoing series of operation is continuously performed for the entire region of an accelerator. Accordingly, the combustion-chamber volume varies according to the amount of intake air. As a result, the combustion pressure is kept at an ideal combustion pressure (i.e., constant pressure burn: CPB is obtained), to accomplish the third task.

Although the accelerator response of the engine becomes slow accordingly, a signal system is programmed such that the accelerator opening degree signal indicating the amount of intake air is consistently maintained until compression of the current intake air is completed to cause ignition, in a throttle valve and the collision mechanism. Further, when the accelerator opening degree suddenly shifts to much greater values during a period in which the accelerator operates in a small region, the generated running torque does not reach a required compression torque in some cases. To prevent such cases, a program for step-up to an accelerator opening degree at an intermediate stroke is also required.

A collision cancel mechanism including pull-out plates (23-1, 23-2) for canceling collision, solenoids (25-1, 25-2) serving as actuators of these pull-out plates (23-1, 23-2), and bearings for reducing friction, is provided in the colliding parts (13-1, 13-2) of the variable correlating crankshafts (43-1, 43-2, 44-1, 44-2) or the collision receiving parts (24-1, 24-2) of the variable correlating crankshafts (42-1, 42-2) described above. In addition, weights (26-1, 26-2), springs (22-1*a*, 22-1*b*, 22-2*a*, 22-2*b*) for supporting the weights, and bearings and weight rails (27-1, 27-2) for allowing smooth movement of the weights (26-1, 26-2) are provided in a portion near the external periphery of the variable correlating crankshafts (42-1, 42-2, 43-1; 43-2, 44-1, 44-2). These variable correlating crankshafts will be referred to as inertial-force correlating crankshafts (45-1, 45-2, 46-1, 46-2) hereinafter, and are recited in claim 5 or 6. The inertial-force correlating crankshafts accomplish the fourth task in the following four manners:

A: when the rotation speed of the inertial-force correlating crankshafts (45-1, 45-2, 46-1, 46-2) varies upon collision in a last period of a compression stroke, inertial motion energy of the weights (26-1, 26-2) at both ends of collision, i.e., the colliding parts, and the collision receiving parts, is stored in the springs (22-1*a*, 22-1*b*, 22-2*a*, 22-2*b*);

B: when the engine further rotates to reach a given collision cancel position, the solenoids (25-1, 25-2) pull out the pull-out plates (23-1, 23-2), thereby obtaining a state in which the collision is cancelled;

C: the restoring force of the springs (22-1*a*, 22-1*b*, 22-2*a*, 22-2*b*) causes the inertial-force correlating crankshafts (45-1, 45-2, 46-1, 46-2) to approach each other by a distance corresponding to the thickness of the pull-out plates (23-1, 23-2);

D: the combustion-chamber volume of inter-piston space decreases, and the combustion-chamber is pressurized to a pressure at which self-ignition occurs, thereby causing the engine to be in an explosion stroke caused by self-ignition, which is homogeneous charge compression ignition (HCCI) and does not require an ignition unit or an advanced high-pressure fuel injection unit in the engine; and E: control signal power to the solenoids is supplied through the sliding connectors (19-1, 19-2).

DESCRIPTION OF REFERENCE CHARACTERS

Figure 1:
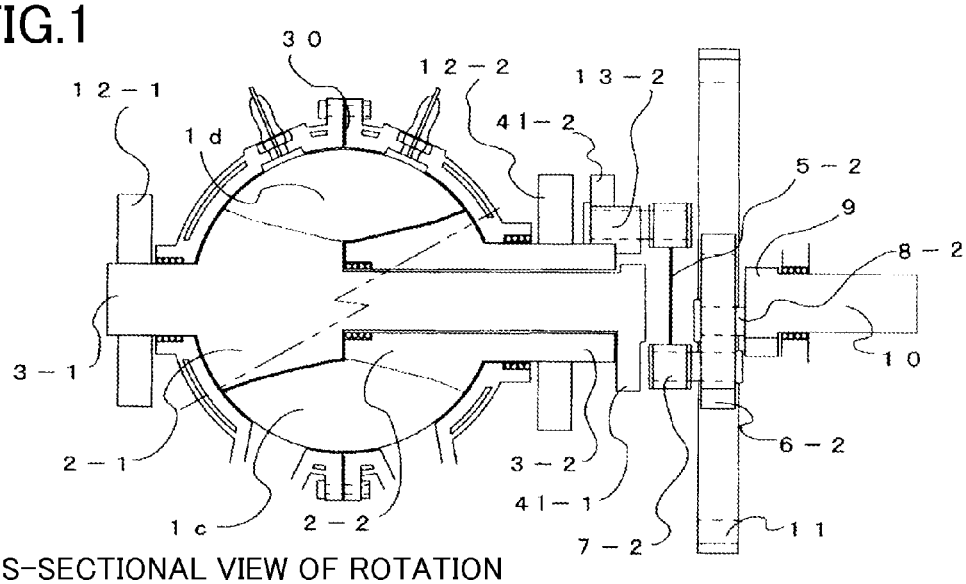
FIG. 1 shows cross-sectional views illustrating an example of an internal combustion engine of claim 1.
Figure 1:
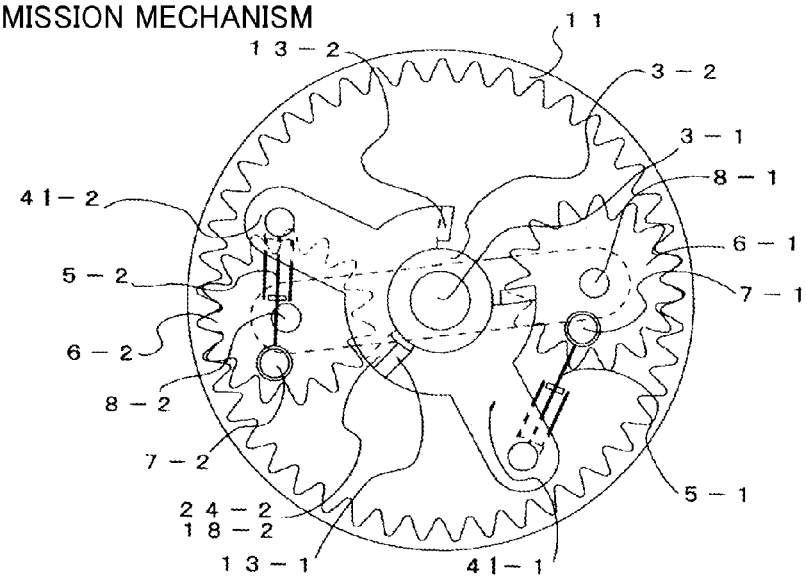
Figure 1:
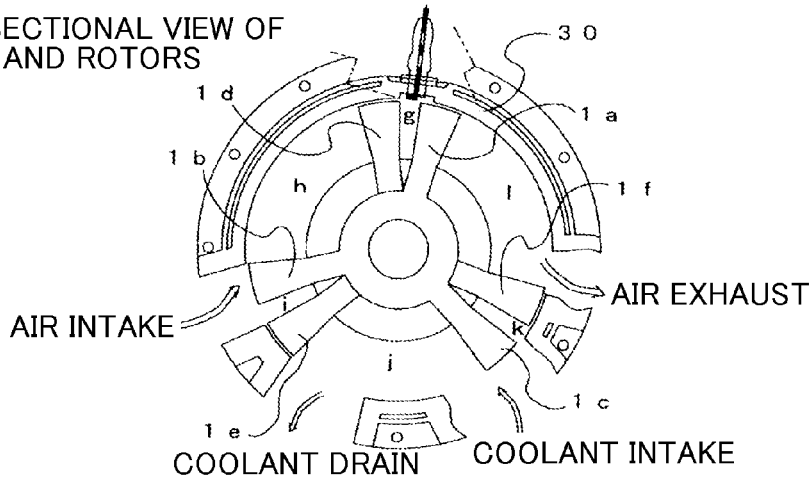

1*a*, 1*b*, 1*c*; 1*d*, 1*e*, 1*f* piston
2-1, 2-2 rotor
3-1, 3-2 rotor shaft
5-1, 5-2 link member
6-1, 6-2 planet gear
7-1, 7-2 eccentric rod
8-1, 8-2 rotational axis
9 output arm
10 output shaft
11 fixed internal gear frame
12-1, 12-2 one-way clutch
13-1, 13-2 colliding part
14-1, 14-2 slide rail
15-1, 15-2 stepper motor
16-1, 16-2 driving wire
16-1*a*, 16-1*b*, 16-2*a*, 16-2*b* driving wire
17-1, 17-2 reel
18-1, 18-2 buffer material
19-1, 19-2 sliding connector
20 position sensor
21-1*a*, 21-1*b*, 21-2*a*, 21-2*b* slide wedge
22-1*a*, 22-1*b*, 22-2*a*, 22-2*b* spring
23-1, 23-2 pull-out plate
24-1, 24-2 collision receiving part
25-1, 25-2 solenoid
26-1, 26-2 weight
27-1, 27-2 weight rail
28-1, 28-2 collision holder
29-1, 29-2 worm gear
30 cylinder housing
31-1, 31-2 wire driving pulley
41-1, 41-2 correlating crankshaft
42-1, 42-2 variable correlating crankshaft
43-1, 43-2 variable correlating crankshaft
44-1, 44-2 variable correlating crankshaft
45-1, 45-2 inertial-force correlating crankshaft
46-1, 46-2 inertial-force correlating crankshaft
g, h, i, j, k, l space between pistons

DESCRIPTION OF EMBODIMENTS

Figure 2:
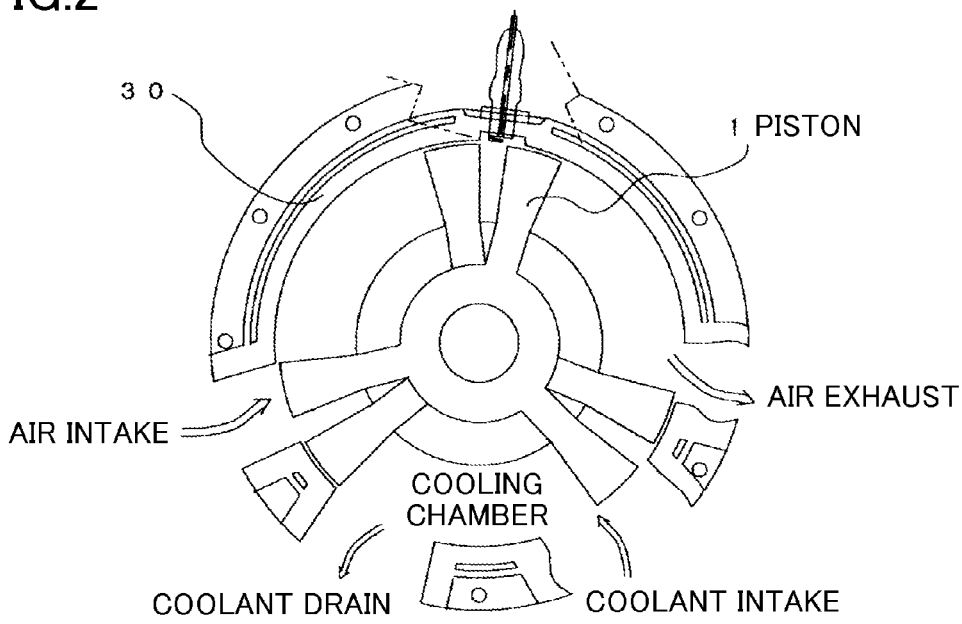
FIG. 2 shows cross-sectional views illustrating a rotation transmission mechanism including a cooling chamber and of the internal combustion engine of claim 1 together with a rotational path of an eccentric rod.
Figure 2:
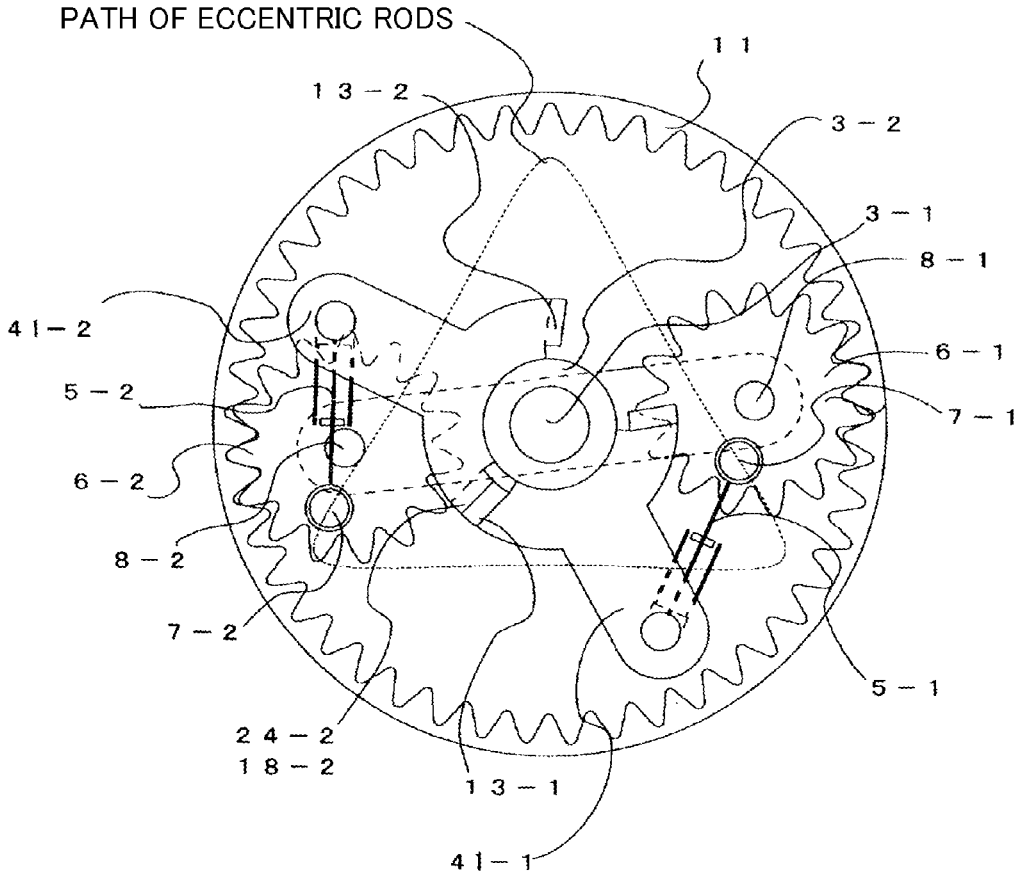
Figure 3:
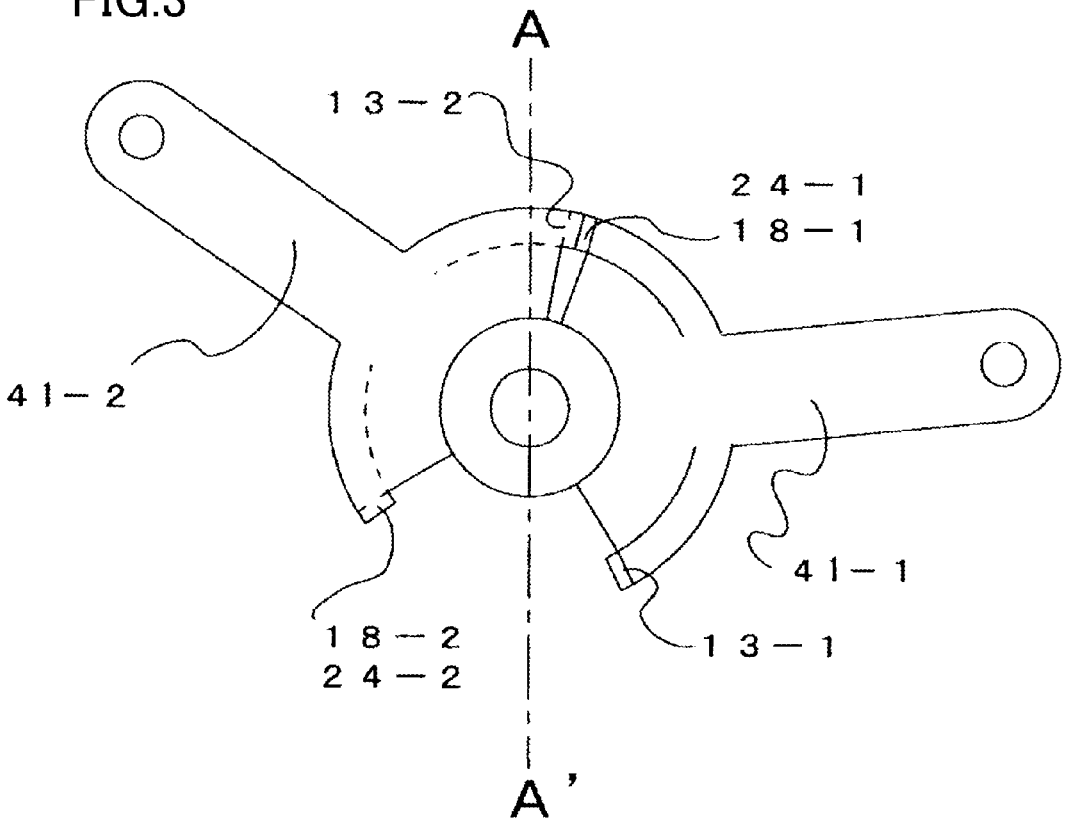
FIG. 3 shows correlating crankshafts (41-1, 41-2).
Figure 3:
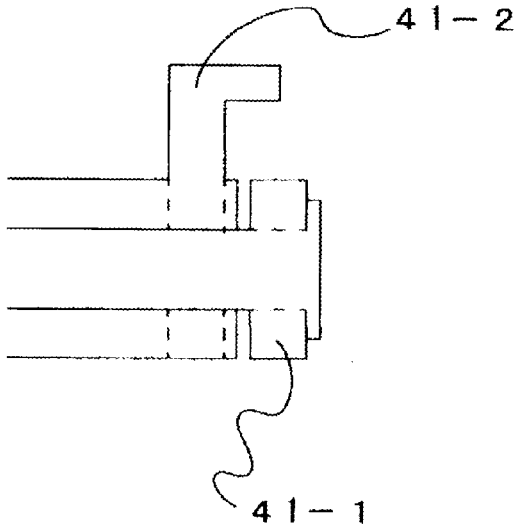
Figure 4:
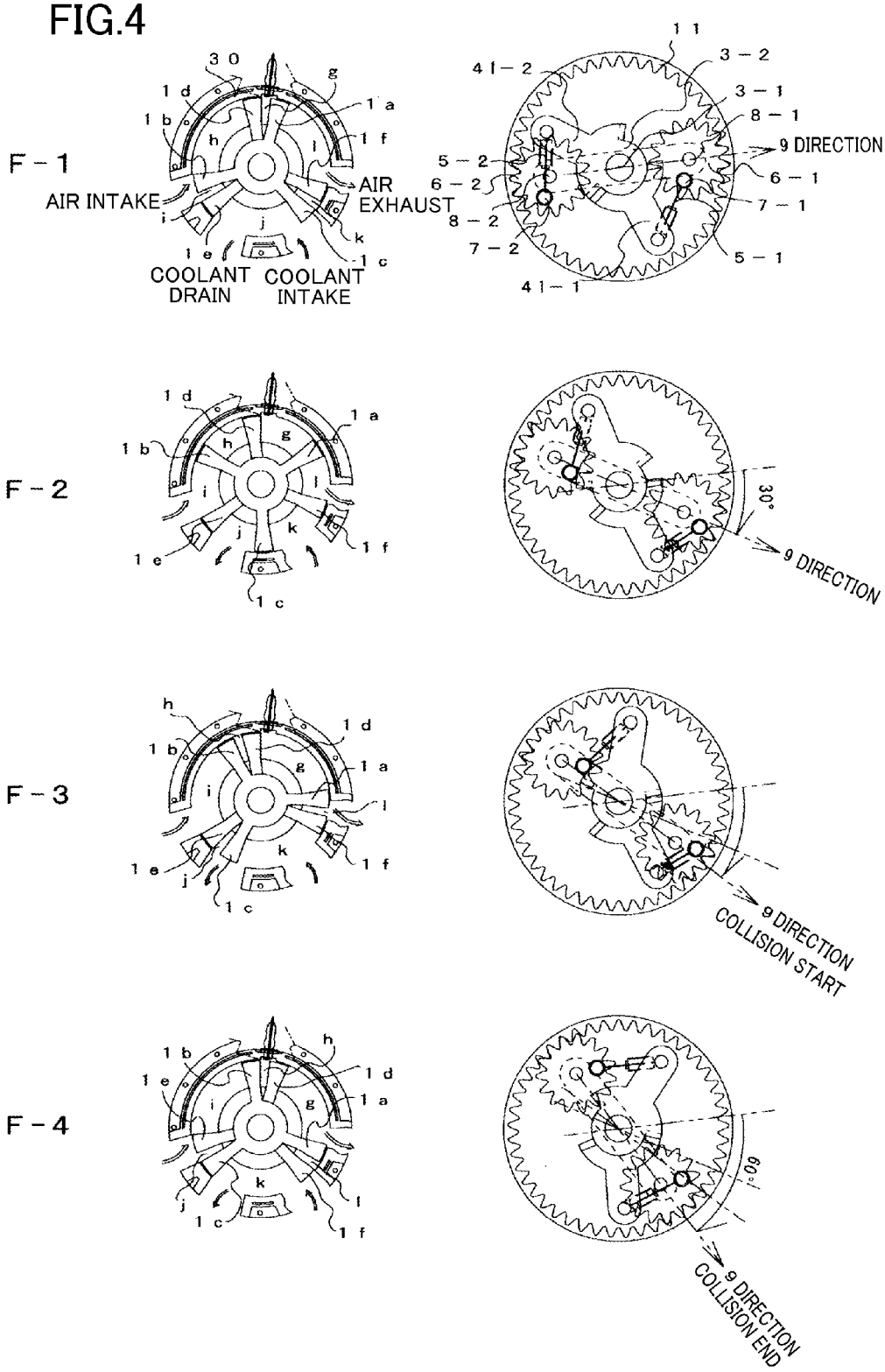
FIG. 4 shows positional relationships among parts with rotation of the internal combustion engine of claim 1.

FIG. 1 illustrates an example of an internal combustion engine of claim 1 as a gasoline engine. FIG. 2 illustrates cross-sectional views showing a detail of a cooling chamber of a cylinder housing and a rotation transmission mechanism in the above engine. FIG. 3 illustrates correlating crankshafts (41-1, 41-2) used in the above engine in detail. FIG. 4 illustrates motion of parts and positional relationships with rotation of the engine.

Figure 5:
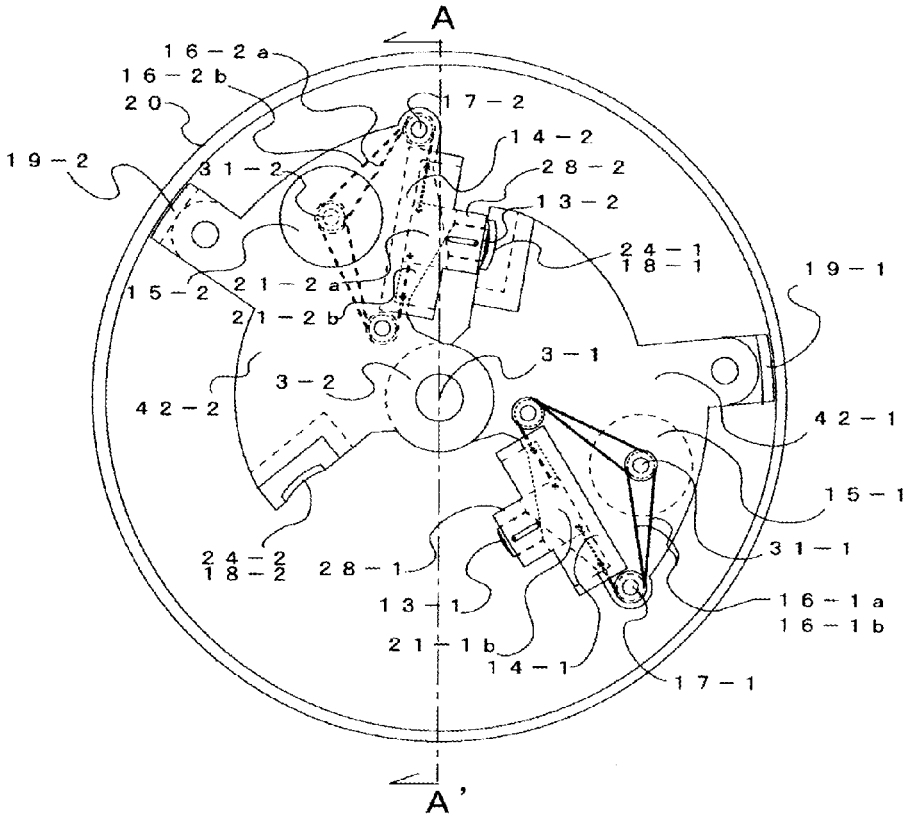
FIG. 5 shows variable correlating crankshafts (42-1, 42-2) of claim 2.
Figure 5:
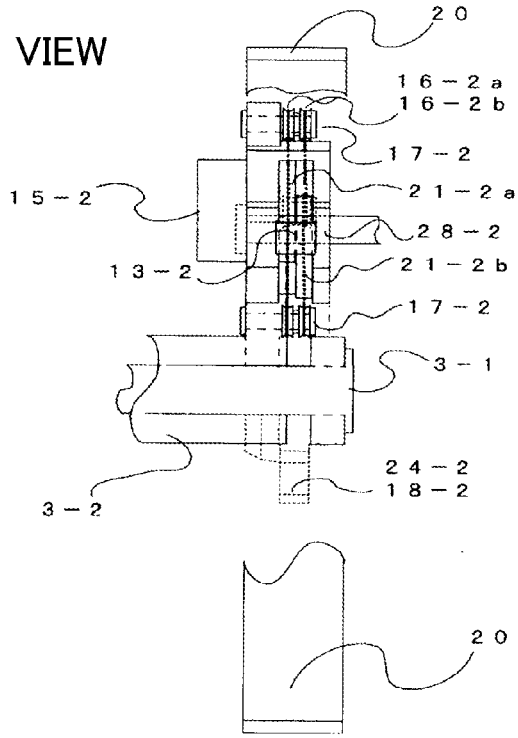

FIG. 5 illustrates an example of variable correlating crankshafts (42-1, 42-2) of claim 2.

Figure 6:
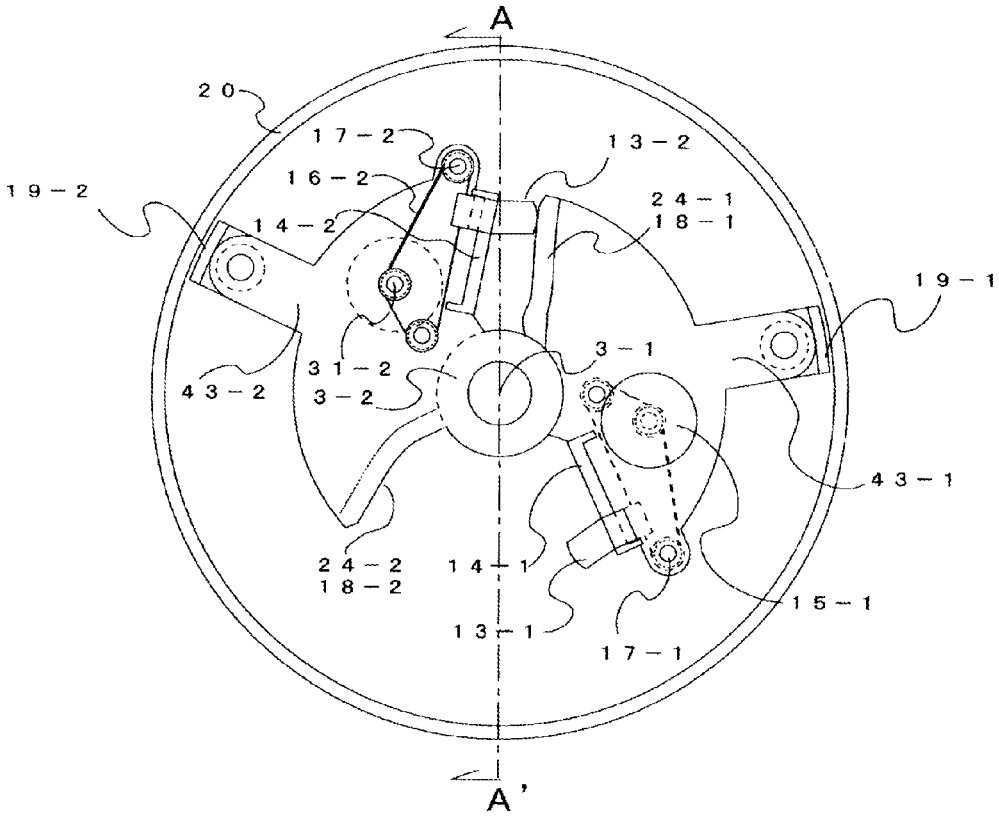
FIG. 6 shows variable correlating crankshafts (43-1, 43-2) of claim 3.
Figure 6:
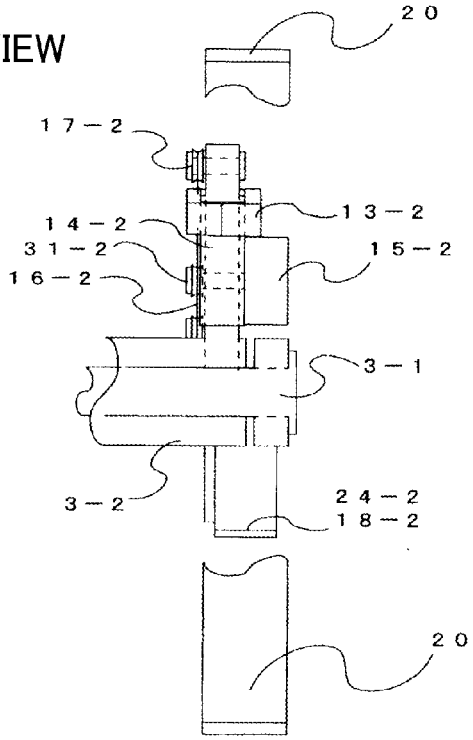

FIG. 6 illustrates an example of variable correlating crankshafts (43-1, 43-2) of claim 3.

Figure 7:
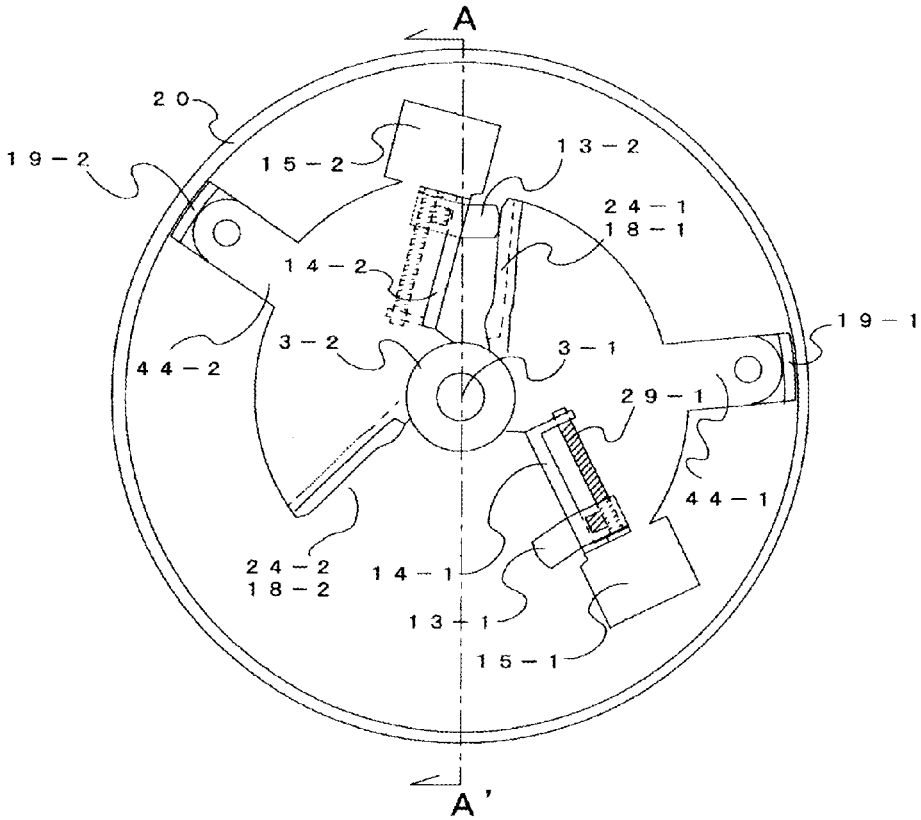
FIG. 7 shows variable correlating crankshafts (44-1, 44-2) of claim 4.
Figure 7:
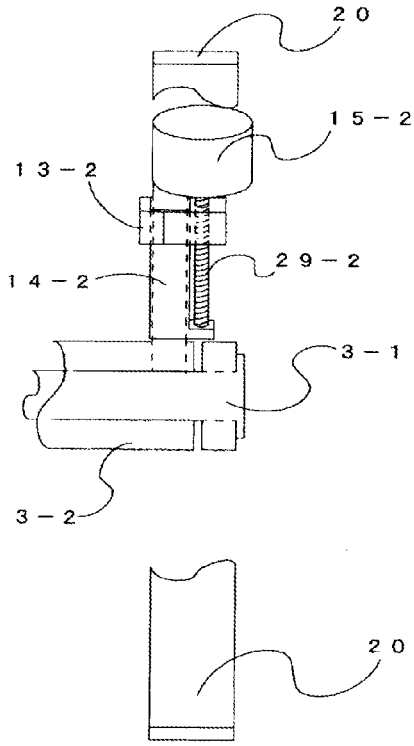

FIG. 7 illustrates an example of variable correlating crankshafts (44-1, 44-2) of claim 4.

Figure 8:
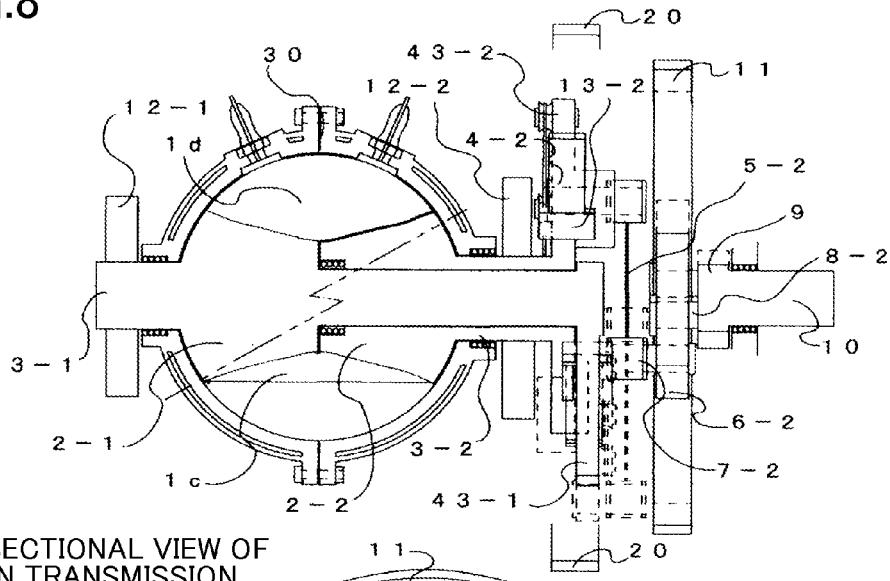
FIG. 8 shows a CPB internal combustion engine using the variable correlating crankshafts (43-1, 43-2) of claim 3.
Figure 8:
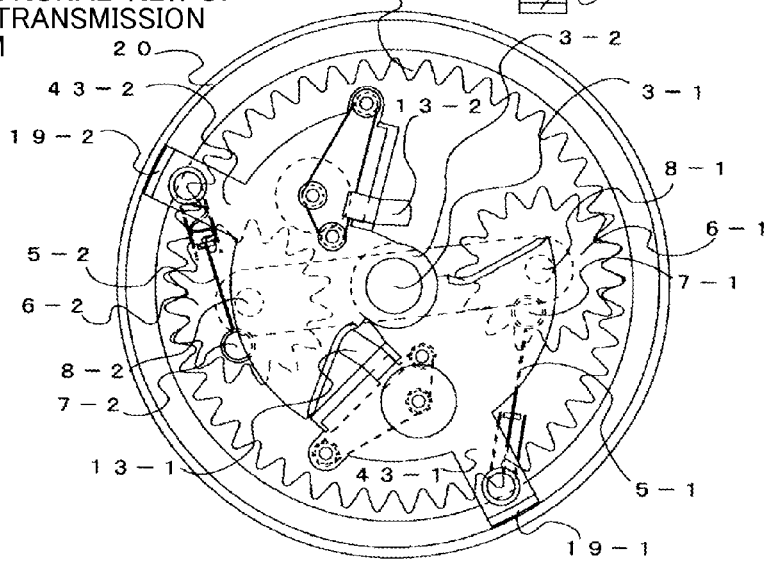
Figure 8:
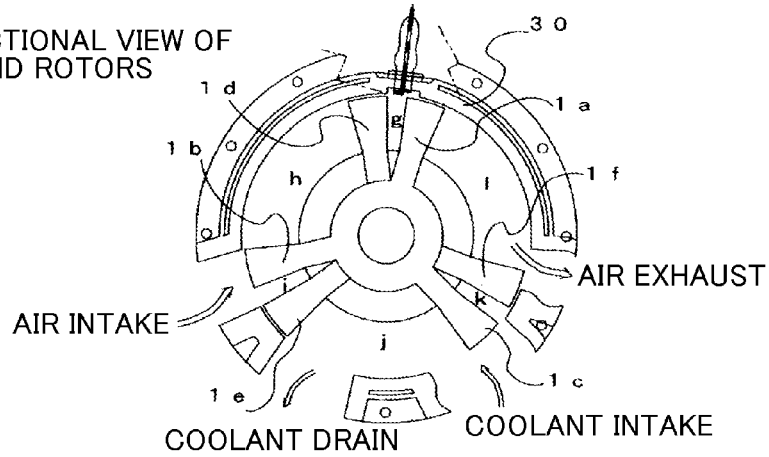
Figure 9:
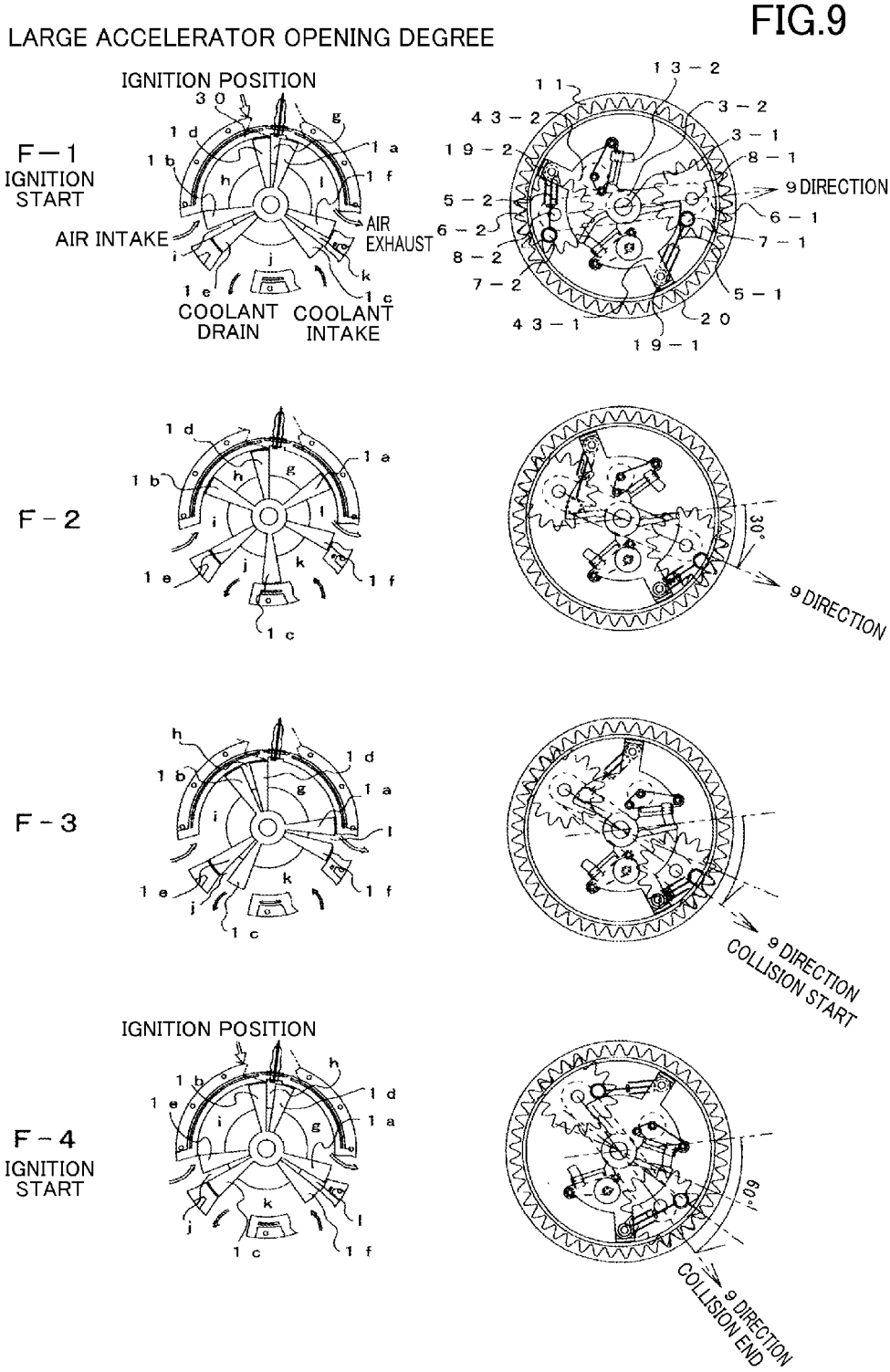
FIG. 9 shows positional relationships among parts with rotation with a large accelerator opening degree of the CPB internal combustion engine using the variable correlating crankshafts (43-1, 43-2) of claim 3.
Figure 10:
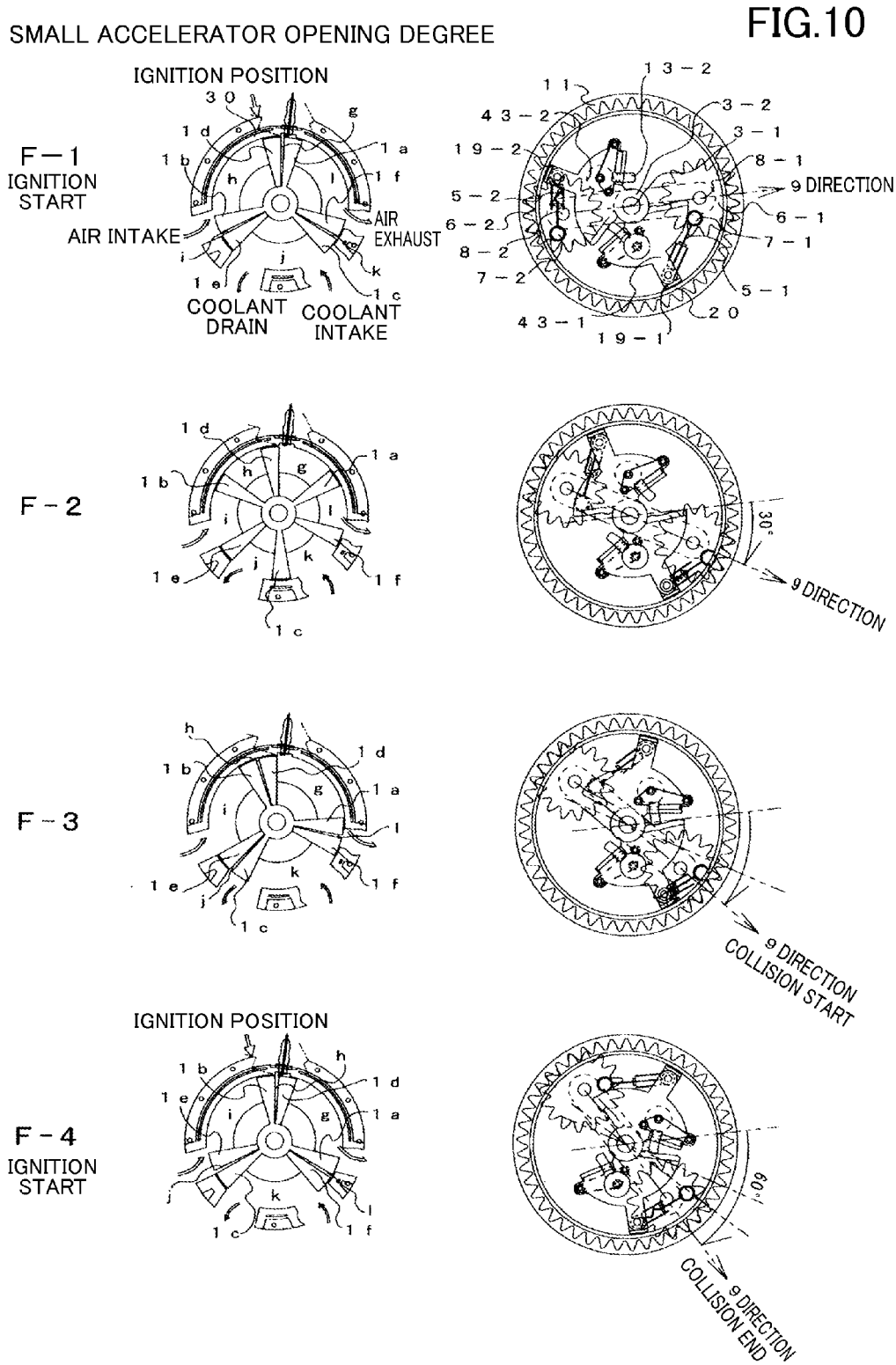
FIG. 10 shows positional relationships among parts with rotation with a small accelerator opening degree of the CPB internal combustion engine using the variable correlating crankshafts (43-1, 43-2) of claim 3.

FIG. 8 illustrates cross-sectional views of an example of a CPB internal combustion engine using the variable correlating crankshafts (43-1, 43-2) of claim 3. FIG. 9 illustrates positional relationships among parts with rotation with a large accelerator opening degree of this engine. FIG. 10 shows positional relationships among parts with rotation with a small accelerator opening degree of the engine.

Figure 11:
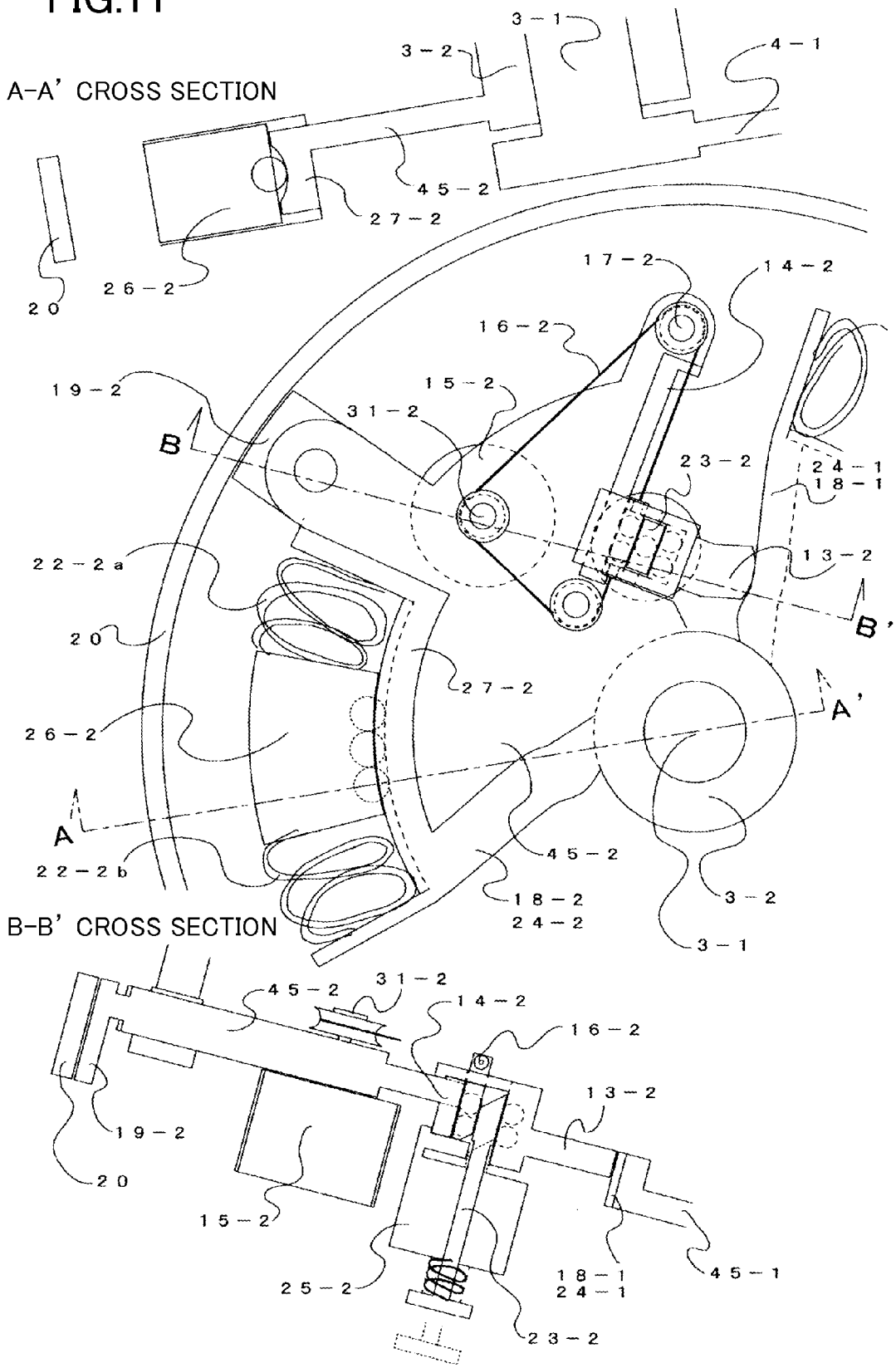
FIG. 11 shows inertial-force correlating crankshafts (44-1, 44-2) of claim 5.
Figure 12:
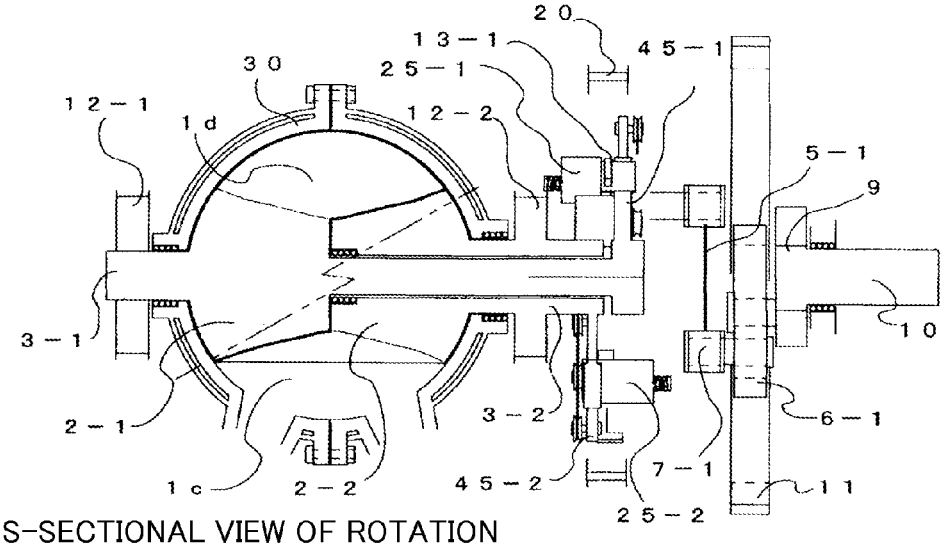
FIG. 12 shows an HCCI internal combustion engine using the inertial-force correlating crankshafts (44-1, 44-2) of claim 5.
Figure 12:
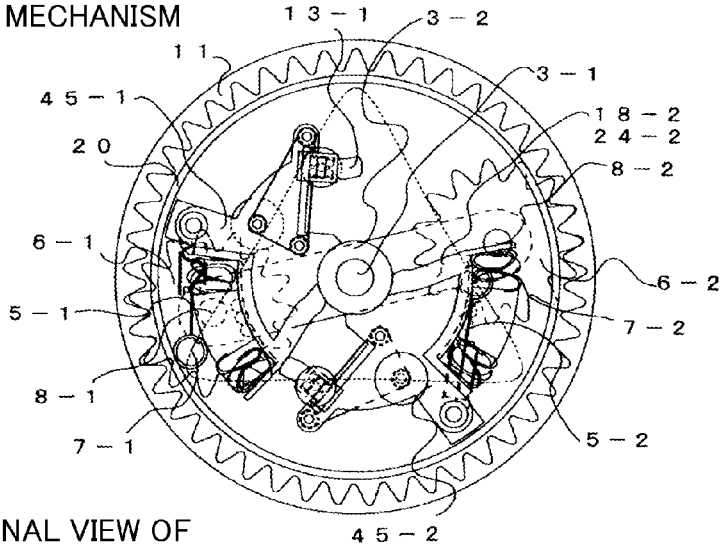
Figure 12:
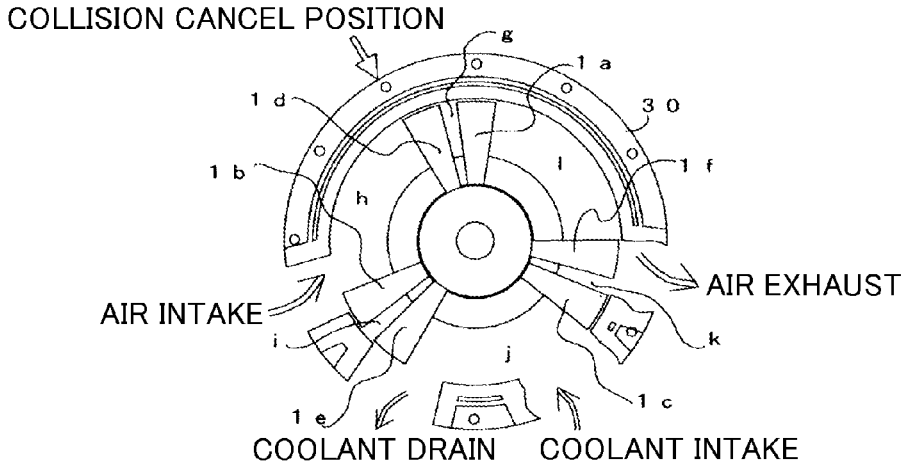
Figure 13:
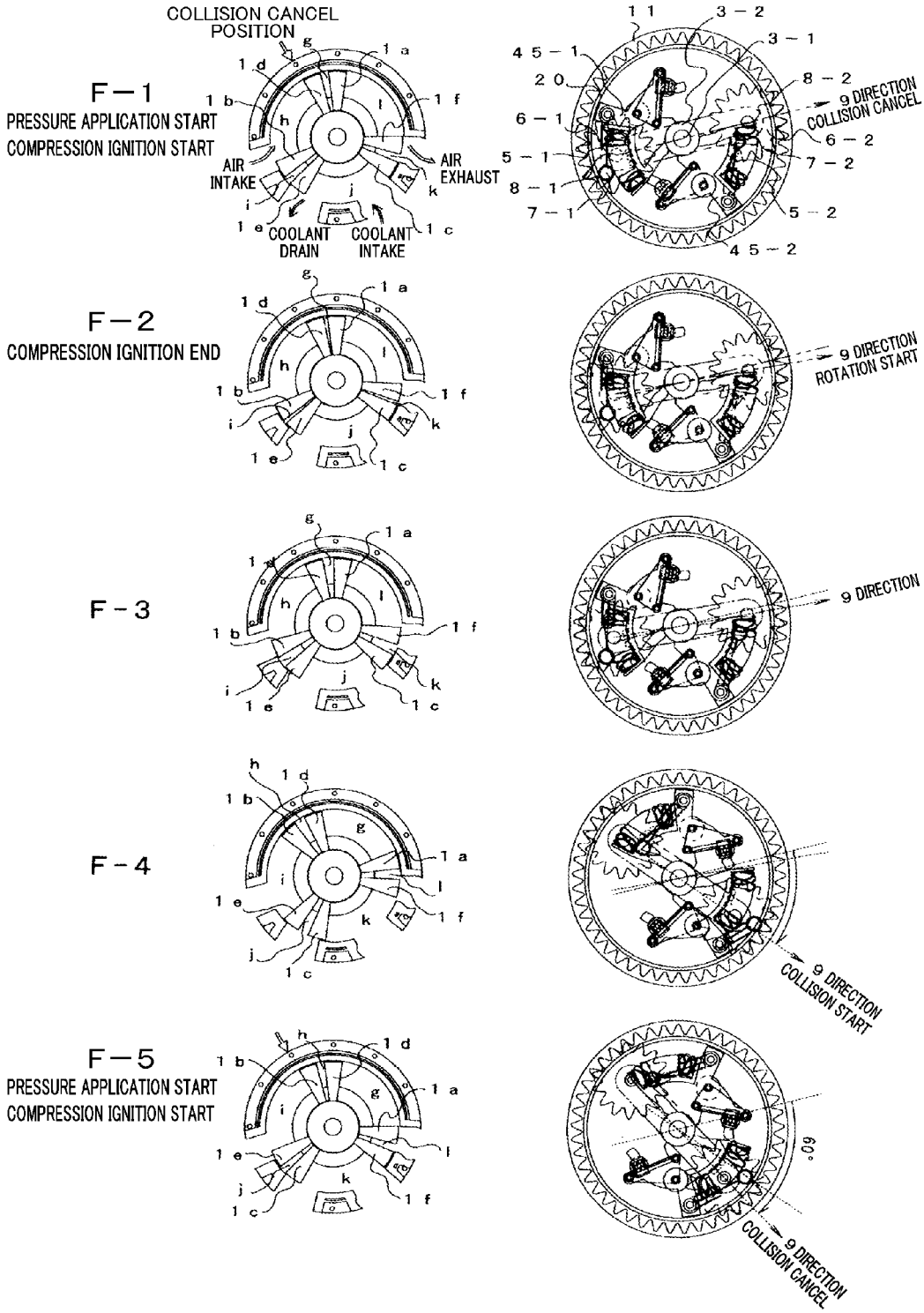
FIG. 13 shows positional relationships among parts with rotation with a large accelerator opening degree of the HCCI internal combustion engine using the inertial-force correlating crankshafts (44-1, 44-2) of claim 5.

FIG. 11 illustrates an example of inertial-force correlating crankshafts (45-1, 45-2) of claim 5. FIG. 12 illustrates an example of an HCCI internal combustion engine using these crankshafts. FIG. 13 shows positional relationships among parts with rotation with a large accelerator opening degree of this HCCI internal combustion engine.

The invention claimed is:

1. A cat-and-mouse internal combustion engine comprising:

an engine body;

first and second rotors each having a rotor shaft;

first and second one-way clutches between the engine body and the first and second rotor shafts;

correlating crankshafts including projecting colliding parts and collision receiving parts with buffer materials;

a cylinder housing;

concentric rotor shafts outwardly extending from the cylinder housing two planet gears having respective central rotational axes and respectively including eccentric rods in an identical phase at an identical distance from the rotational axes;

link members having an identical length to rotate about an axis;

eccentric rods projecting from the two planet gears at a right angle through the link members;

first and second piston members each including a plurality of pistons, the pistons being configured to partition the cylinder housing into six chambers, at least one of the chambers serving as an explosion expansion chamber during an explosion stroke, and the pistons being arranged in sets of three at a pitch of 120° in each of the rotors;

an output arm having first and second ends, an axis at the first and second ends and an output shaft at a center of the output arm;

a fixed internal gear frame having a number of teeth that is three times as large as a number of teeth of each of the planet gears;

an air intake port;

an air exhaust port;

an ignition plug or a fuel injection nozzle;

a coolant intake port, a coolant injection nozzle, and a coolant drain port, wherein the crankshafts are configured to collide against each other at an angle and are attached to ends of the concentric rotor shafts, and the correlating crankshafts are respectively coupled to the eccentric rods, wherein the link members are configured to become tense to transmit, to the correlating crankshafts, rotational forces on the pistons at front portions of the explosion expansion chamber in the explosion stroke, and the link members are configured to relax and bend to prevent reverse rotational forces on the pistons at rear portions of the explosion expansion chamber from being transmitted to the connected correlating crankshafts, wherein the central rotational axes of the two planet gears are rotatably disposed to be symmetric with respect to the axis at the first and second ends of the output arm, and configured to orbit around the output shaft at the center of the output arm together with rotation of the output arm, wherein the two planet gears are internally meshed with the fixed internal gear frame and configured to rotate with sun-and-planet motion such that the planet gears revolve once and rotates three times for every turn of the output shaft and the output arm, wherein rotation of the output shaft is configured to cause the two eccentric rods to form a common path and to rotate with a periodic change in angular velocity, while being shifted by 120° when viewed from the output shaft, wherein the change in angular velocity is transmitted through the link member and the correlating crankshafts so that rotation is performed with an increase/decrease of a volume of each of the six chambers, wherein when the engine is in the explosion stroke, the one-way clutches receive reverse rotational forces on the pistons at the rear portions of the explosion expansion chamber to prevent reverse rotation of the pistons and to support an effective transfer of an explosion expansion pressure to the pistons, wherein the air intake port, the air exhaust port, and the ignition plug or a fuel injection nozzle are provided in the cylinder housing so that portions of the pistons in the cylinder housing whose chamber volume increases with rotation are used for an intake stroke, wherein portions of the pistons whose chamber volume at front portions of the pistons in a rotational direction decreases are used for a compression stroke;

wherein portions of the pistons whose chamber volume increases with further rotation are used for an explosion stroke, wherein portions of the pistons whose chamber volume at front portions of the pistons decreases are used for an exhaust stroke, and wherein the coolant intake port, the coolant injection nozzle, and the coolant drain port are provided in the cylinder housing so that remaining chamber-volume increase portions and chamber-volume decrease portions before one turn of the pistons are used as cooling chambers for coolant intake and coolant drain.

2. The cat-and-mouse internal combustion engine according to claim 1, wherein the correlating crankshafts comprise variable correlating crankshafts and the internal combustion engine further comprises:

stepper motors having shafts;

wire driving pulleys for attachment to the shafts of the stepper motors, the wire drive pulleys having drums and are configured to be controlled according to an accelerator opening degree;

reels;

slide rails;

two slide wedges that slide along the slide rails via the reels, the slide wedges having slides;

two driving wires wound around the drums in normal and reverse directions, each driving wire having first and second ends that are coupled to two slide wedges;

sliding connectors for receiving signal power for controlling the stepper motors provided at tips of the correlating crankshafts;

a V-shaped valley configured to be formed of bevel edges of the two slide wedges whose slopes face each other and which extend in parallel with each other in opposite directions, the V-shaped valley configured to have its depth varied according to the slides of the slide wedges;

colliding parts located on middle portions of the valley; and collision holders, wherein the V-shaped valley is configured to allow the colliding parts to vertically slide within the collision holders so that an angle of collision between the correlating crankshafts is changed, so that a component of an impact force of the collision in a lateral direction is cancelled by the valley, and so that kinetic energy is transmitted to the associated correlating crankshafts without a shift of directional properties of the kinetic energy, and wherein the correlating crankshafts are provided with a variable collision mechanism including:

the stepper motors;

the sliding connectors;

the wire driving pulleys;

the driving wires;

the reels;

the slide rails;

the colliding parts;

the collision holders; and collision receiving parts.

3. The cat-and-mouse internal combustion engine according to claim 1, wherein the correlating crankshafts comprise variable correlating crankshafts and the internal combustion engine further comprises:

stepper motors having shafts;

wire driving pulleys for attachment to the shafts of the stepper motors, the wire drive pulleys having drums and are configured to be controlled according to an accelerator opening degree, reels;

slide rails;

colliding parts having slides;

a single driving wire wound around the drums, the driving wire having first and second ends coupled to the colliding parts via the reels so that positions of the colliding parts configured to slide across the slide rails on the rails are set by feed speed of the driving wire;

collision receiving parts provided with buffer materials of the correlating crankshafts, the collision receiving parts being formed in a shape of a combustion-chamber volume between the pistons and configured to be formed upon collision in association with positions after the slides of the colliding parts continuously vary;

sliding connectors for receiving signal power for controlling the stepper motors, the sliding connectors being provided at tips of the correlating crankshafts, wherein the variable correlating crankshafts are provided with a variable collision mechanism including:

the stepper motors;

the sliding connectors;

the wire driving pulleys;

the driving wire;

the reels;

the slide rails;

the colliding parts and the collision receiving parts.

4. The cat-and-mouse internal combustion engine according to claim 1, wherein the correlating crankshafts comprise variable correlating crankshafts and the internal combustion engine further comprises:

worm gears;

stepper motors serving as actuators of the worm gears, colliding parts having slides;

collision receiving parts provided with buffer materials of the correlating crankshafts, the collision receiving parts being formed in a shape of a combustion-chamber volume between the pistons and configured to be formed upon collision in association with positions after the slides of the colliding parts continuously vary;

sliding connectors for receiving signal power for controlling the stepper motors, the sliding connectors being provided at tips of the correlating crankshafts, wherein the variable correlating crankshafts are provided with a variable collision mechanism including:

the sliding connectors;

the colliding parts and the collision receiving parts.

5. The cat-and-mouse internal combustion engine according to claim 3, wherein the colliding parts include pull-out plates for canceling collision and solenoids for pulling out the pull-out plates, and the internal combustion engine further comprises:

weights having springs, bearings and rails for smooth movement of the weights provided in an external periphery of the crankshafts, wherein the sliding connectors for receiving control signal power for allowing the solenoids to pull out the pull-out plates are provided at tips of the correlating crankshafts.

6. The cat-and-mouse internal combustion engine according to claim 2, wherein the collision parts include pull-out plates for canceling collision and solenoids for pulling out the pull-out plates, and the internal combustion engine further comprises:

weights having springs, bearings and weight rails for smooth movement of the weights provided in an external periphery of the crankshafts, wherein the sliding connectors for receiving control signal power for allowing the solenoids to pull out the pull-out plates are provided at tips of the correlating crankshafts.

7. The cat-and-mouse internal combustion engine according to claim 4, wherein the colliding parts include pull-out plates for canceling collision and solenoids for pulling out the pull-out plates, and the internal combustion engine further comprises:

weights having springs, bearings and rails for smooth movement of the weights provided in an external periphery of the crankshafts, wherein the sliding connectors for receiving control signal power for allowing the solenoids to pull out the pull-out plates are provided at tips of the correlating crankshafts.

* * * * *